US008366882B2

(12) United States Patent
Rinker

(10) Patent No.: US 8,366,882 B2
(45) Date of Patent: Feb. 5, 2013

(54) PROCESS FOR TREATING AGGLOMERATING COAL BY REMOVING VOLATILE COMPONENTS

(75) Inventor: Franklin G. Rinker, Naples, FL (US)

(73) Assignee: C20 Technologies, LLC, Lexington, KY (US)

( * ) Notice: Subject to any disclaimer, the term of this patent is extended or adjusted under 35 U.S.C. 154(b) by 737 days.

(21) Appl. No.: 12/556,977

(22) Filed: Sep. 10, 2009

(65) Prior Publication Data

US 2011/0011720 A1 Jan. 20, 2011

Related U.S. Application Data

(60) Provisional application No. 61/225,406, filed on Jul. 14, 2009.

(51) Int. Cl.
*C10B 53/08* (2006.01)

(52) U.S. Cl. ..... 201/8; 201/9; 201/17; 201/22; 201/30; 201/31

(58) Field of Classification Search ..... 201/8, 9, 201/17, 22, 30, 31
See application file for complete search history.

(56) References Cited

U.S. PATENT DOCUMENTS

| | | | | |
|---|---|---|---|---|
| 1,814,980 | A | | 7/1931 | Wessel |
| 1,976,908 | A | | 10/1934 | Wittenberg |
| 2,029,883 | A | | 2/1936 | MacCubbin et al. |
| 2,040,100 | A | | 5/1936 | Miller |
| 2,044,764 | A | | 6/1936 | Bywater |
| 2,260,072 | A | | 10/1941 | Wilton |
| 2,366,900 | A | | 1/1945 | Weir |
| 2,528,553 | A | | 11/1950 | Royster |
| 2,666,796 | A | | 1/1954 | Gorin et al. |
| 2,693,409 | A | | 11/1954 | Stephens, Jr. |
| 2,748,063 | A | | 5/1956 | Radasch |
| 2,774,716 | A | | 12/1956 | Kulik |
| 3,010,893 | A | | 11/1961 | Kulik |
| 3,375,175 | A | | 3/1968 | Eddinger et al. |
| 3,463,310 | A | | 8/1969 | Ergun et al. |
| 3,574,065 | A | | 4/1971 | Eddinger et al. |
| 3,585,732 | A | | 6/1971 | Itahashi |
| 3,736,233 | A | * | 5/1973 | Sass et al. ..... 201/17 |
| 3,938,966 | A | | 2/1976 | Kindig et al. |
| 4,028,219 | A | | 6/1977 | Baldwin et al. |
| 4,036,603 | A | | 7/1977 | Bernet et al. |

(Continued)

OTHER PUBLICATIONS

Dadayburjor, et al., Coal Conversion Processes Liquefaction, Kirk-Othmer Encyclopedia of Chemical Technology, 2003, vol. 6, pp. 832-869.

(Continued)

*Primary Examiner* — Nina Bhat
(74) *Attorney, Agent, or Firm* — MacMillan, Sobanski & Todd, LLC

(57) ABSTRACT

A process for treating agglomerating coal includes providing dried, pulverized, agglomerating coal, and treating the coal in a vessel with a gas stream having an oxygen content sufficient to form at least some oxides on surface of coal particles, wherein the oxides are sufficient to convert coal into substantially non-agglomerating coal. The treated coal is transferred into a pyrolyzing chamber and passed into contact with an oxygen deficient sweep gas, the sweep gas being at a higher temperature than the temperature of the coal so that heat is supplied to the coal. The process further includes providing additional heat to coal indirectly by heating the chamber, wherein the heating of coal by the sweep gas and by the indirect heating from the chamber causes condensable volatile components to be released into the sweep gas. The sweep gas is removed from the chamber and treated to remove condensable components of coal.

25 Claims, 8 Drawing Sheets

U.S. PATENT DOCUMENTS

| | | | | |
|---|---|---|---|---|
| 4,052,170 | A | | 10/1977 | Yan |
| 4,119,523 | A | | 10/1978 | Baldwin et al. |
| 4,146,367 | A | | 3/1979 | Hsu |
| 4,149,939 | A | | 4/1979 | Solano |
| 4,156,595 | A | | 5/1979 | Scott et al. |
| 4,213,826 | A | | 7/1980 | Eddinger et al. |
| 4,234,386 | A | | 11/1980 | Stirling |
| 4,341,598 | A | | 7/1982 | Green |
| 4,395,309 | A | | 7/1983 | Esztergar |
| 4,411,766 | A | | 10/1983 | Garg et al. |
| 4,411,767 | A | | 10/1983 | Garg |
| 4,466,362 | A | | 8/1984 | Maxwell et al. |
| 4,469,032 | A | * | 9/1984 | Yan ..... 110/342 |
| 4,534,847 | A | | 8/1985 | Roberts et al. |
| 4,605,790 | A | | 8/1986 | Wojtkowski |
| 4,678,478 | A | | 7/1987 | Kelland |
| 4,834,650 | A | | 5/1989 | Docherty et al. |
| 5,017,283 | A | | 5/1991 | Oder |
| 5,114,700 | A | | 5/1992 | Meihack et al. |
| 5,127,586 | A | | 7/1992 | Oder |
| 5,151,159 | A | | 9/1992 | Wolfe et al. |
| 5,171,406 | A | | 12/1992 | Shang et al. |
| 5,176,260 | A | | 1/1993 | Oder |
| 5,240,592 | A | | 8/1993 | Meyer et al. |
| 5,326,457 | A | | 7/1994 | Stipanovich, Jr. |
| 5,372,497 | A | | 12/1994 | Coolidge et al. |
| 5,373,648 | A | | 12/1994 | Wolf |
| 5,401,364 | A | * | 3/1995 | Rinker ..... 201/1 |
| 5,496,465 | A | | 3/1996 | Fraas |
| 5,547,549 | A | | 8/1996 | Fraas |
| 5,601,692 | A | | 2/1997 | Rinker et al. |
| 5,711,769 | A | * | 1/1998 | Rinker et al. ..... 44/620 |
| 5,730,069 | A | | 3/1998 | Coolidge et al. |
| 5,997,289 | A | | 12/1999 | Dover |
| 6,146,432 | A | * | 11/2000 | Ochs et al. ..... 44/501 |
| 2007/0272538 | A1 | | 11/2007 | Satchell |
| 2008/0116052 | A1 | | 5/2008 | Eatough et al. |
| 2009/0119981 | A1 | | 5/2009 | Drozd et al. |
| 2011/0011720 | A1 | | 1/2011 | Rinker |

OTHER PUBLICATIONS

The International Search Report and the Written Opinion, PCT/US2010/041918, dated Feb. 24, 2011.

International Search Report and Written Opinion, Application No. PCT/US11/51927, Dated Mar. 27, 2012.

Berkowitz N., An Introduction to Coal Technology, 1994, 2nd Edition, pp. 102-103; 164-165.

Kreith, F., Principles of Heat Transfer, 2nd Ed. 1965, pp. 236-238.

Mahajan O. et al., Low-temperature air oxidation of caking coals. 1. Effect on subsequent reactivity of chars produced, Fuel, 1980, vol. 59, January, pp. 3-10.

Oder, R., Dry magnetic Separation of Ash, Sulfur, and Mercury From a Southwestern Wyoming Coal, presented at the 18th International Low Rank Fuels Symposium, Jun. 24-26, 2003, Billings, Mt, pp. 1-6.

* cited by examiner

PROCESS FOR TREATING AGGLOMERATING COAL BY REMOVING VOLATILE COMPONENTS

STATEMENTS REGARDING FEDERALLY SPONSORED RESEARCH AND RELATED APPLICATIONS

The present invention claims the benefit of U.S. Provisional Patent Application No. 61/225,406, filed Jul. 14, 2009, the disclosure of which is incorporated herein by reference in its entirety. This invention is related to co-pending applications entitled "Process For Treating Coal By Removing Volatile Components," and "Process For Treating Bituminous Coal By Removing Volatile Components," filed concurrently herewith. This invention was made with no Government support and the Government has no rights in this invention.

TECHNICAL FIELD

The present invention relates to the field of coal processing, and more specifically to a process for treating agglomerating coal for the production of coal derived liquids (CDLs) and gaseous fuel, and other higher value coal derived products, suitable for use in various industries.

BACKGROUND OF THE INVENTION

Coal in its virgin state is sometimes treated to improve its usefulness and thermal energy content. The treatment can include drying the coal and subjecting the coal to a pyrolysis process to drive off low boiling point organic compounds and heavier organic compounds. Thermal treatment of coal causes the release of certain volatile hydrocarbon compounds having value for further refinement into transportation liquid fuels and other coal derived chemicals. Subsequently, the volatile components can be removed from the sweep gases exiting the pyrolysis process. Thermal treatment of coal causes it to be transformed into coal char by virtue of the evolution of the coal volatiles and products of organic sulfur decomposition, and the magnetic susceptibilities of inorganic sulfur in the resultant char are initiated for subsequent removal of coal ash, sulfur and mercury from the coal char.

The effective removal of such volatile components as coal ash, inorganic sulfur and organic sulfur, and mercury, from coal char is problematic. It would be advantageous if agglomerating coal could be treated in such a manner that would enable volatile components to be effectively removed from the coal at more desirable concentrations, thereby creating a coal char product having reduced ash and sulfur. A process for treating agglomerating coal, including reducing sulfur and ash, evolving valuable coal liquids and fuel gas, increasing calorific value, and improving other properties of the resultant coal char product, is desirable.

SUMMARY OF THE INVENTION

In a broad aspect, there is provided herein a process for treating agglomerating coal. The process includes providing dried, pulverized, agglomerating coal, and treating the coal in a vessel with a gas stream having an oxygen content sufficient to form at least some oxides on a surface of the coal particles, wherein the oxides are sufficient to convert the coal into substantially non-agglomerating coal. The treated coal is transferred into a pyrolyzing chamber and passed into contact with an oxygen deficient sweep gas, the sweep gas being at a higher temperature than the temperature of the coal so that heat is supplied to the coal. The process further includes providing additional heat to coal indirectly by heating the chamber, wherein the heating of coal by the sweep gas and by the indirect heating from the chamber causes condensable volatile components to be released into the sweep gas. The sweep gas is removed from the chamber and treated to remove condensable components of coal.

In certain embodiments, the coal is pulverized to a size within a range of from about minus 40 mesh to about minus 200 mesh.

In certain embodiments, the oxygen content of the gas stream is sufficient to cause the coal to gain weight in an amount within a range of from about 0.5% to about 2.0% of the weight of the coal when the coal is treated for a time of about 30 minutes at a temperature within a range of from about 400° F. to about 600° F.

In certain embodiments, the treating of the coal with the gas stream includes heating the coal to a temperature within a range of from about 400° F. to about 650° F. in an oxidizing rotary retort or an oxidizing fluidized bed vessel.

In certain embodiments, the treated coal is pre-heated to a temperature within a range of from about 550° F. to about 900° F. in a pre-heat rotary retort or a pre-heat fluidized bed vessel.

In certain embodiments, the temperature of the pre-heat rotary retort or pre-heat fluidized bed vessel is controlled to about 550-900° F. so as to remove about 2% to about 10% by weight of coal volatile components from the treated coal while allowing desirable volatiles to remain with the coal particles.

In certain embodiments, the pre-heating step removes volatiles from the treated coal and includes withdrawing off gases from a pre-heat rotary retort or a pre-heat fluidized bed vessel, and then combusting the volatiles in the off gases and transferring thermal energy from the combustion to the pre-heating step.

In certain embodiments, the pyrolyzing chamber is a rotary retort, and the treated coal is heated in the retort to a temperature within a range of from about 900° F. to about 1200° F. so as to produce pulverized coal char, with the sweep gas removed from the chamber having a condensable hydrocarbon content of at least about 25%.

In certain embodiments, the pyrolyzing step creates sulfur in the form of at least one of $H_2S$, $CS_2$, and COS, with the $H_2S$, $CS_2$, and COS being removed from the chamber with the sweep gas, and further includes removing sulfur from the sweep gas.

In certain embodiments, the coal is continuously supplied into one end of the chamber and removed from another end of the chamber, the sweep gas is continuously supplied into one end of the chamber and removed from another end of the chamber, and the sweep gas exiting the chamber has a condensable hydrocarbon content of at least 25% by weight.

In certain embodiments, the sweep gas removed from the chamber includes at least one of $C_3H_8$, $CH_4$, and CO, and further includes at least one of $H_2S$, $CS_2$, and COS.

In certain embodiments, the agglomerating coal has a free-swelling index (FSI) of about 4 or more, which is reduced to an FSI of about 1 or less following treatment of the agglomerating coal.

In another broad aspect, there is provided herein a process for treating agglomerating coal. The process includes providing dried, pulverized, agglomerating coal, and pre-heating the coal to a temperature within a range of from about 550° F. to about 900° F. in a pre-heat rotary retort or a pre-heat fluidized bed vessel. The coal is transferred into a pyrolyzing chamber and an oxygen deficient sweep gas is passed into contact with the coal, the sweep gas being at a higher temperature than the temperature of the coal so that heat is supplied to the coal. The process further includes providing additional heat to the coal indirectly by heating the chamber, wherein the heating of the coal by the sweep gas and by the indirect heating from the chamber causes condensable volatile components to be released into the sweep gas. The sweep gas is removed from the chamber and treated to remove condensable components of the coal.

In certain embodiments, the temperature of the pre-heat rotary retort or pre-heat fluidized bed vessel is controlled to about 600-900° F. so as to remove about 2% to about 10% by weight of coal volatile components from the treated coal while allowing desirable volatiles to remain with the coal particles.

In certain embodiments, the pre-heating step removes volatiles from the treated coal and includes withdrawing off gases from a pre-heat rotary retort or a pre-heat fluidized bed vessel, and then combusting the volatiles in the off gases and transferring thermal energy from the combustion to the pre-heating step.

In certain embodiments, the pyrolyzing chamber is a rotary retort, and the pre-heated coal is heated in the retort to a temperature within a range of from about 850° F. to about 1200° F. so as to produce pulverized coal char, with the sweep gas removed from the chamber having a volatile content of at least about 25%.

In still another broad aspect, there is provided herein a process for treating agglomerating coal. The process includes providing dried, pulverized, agglomerating coal, and treating the coal in a vessel with a gas stream having an oxygen content sufficient to cause the coal to gain weight in an amount within a range of from about 0.5% to about 2% of the weight of the coal and to form at least some oxides on a surface of the coal particles, wherein the oxides are sufficient to convert the coal into substantially non-agglomerating coal. The treated coal is pre-heated to a temperature within a range of from about 550° F. to about 900° F. in a rotary retort or a fluidized bed vessel. The coal is transferred into a pyrolyzing chamber and an oxygen deficient sweep gas is passed into contact with the coal, the sweep gas being at a higher temperature than the temperature of the coal so that heat is supplied to the coal. The process further includes providing additional heat to the coal indirectly by heating the chamber, wherein the heating of the coal by the sweep gas and by the indirect heating from the chamber causes condensable volatile components to be released into the sweep gas. The sweep gas is removed from the chamber and treated to remove condensable components of the coal.

Various advantages of this invention will become apparent to those skilled in the art from the following detailed description of the preferred embodiment, when read in light of the accompanying drawings.

DETAILED DESCRIPTION OF THE INVENTION

Figure 1:
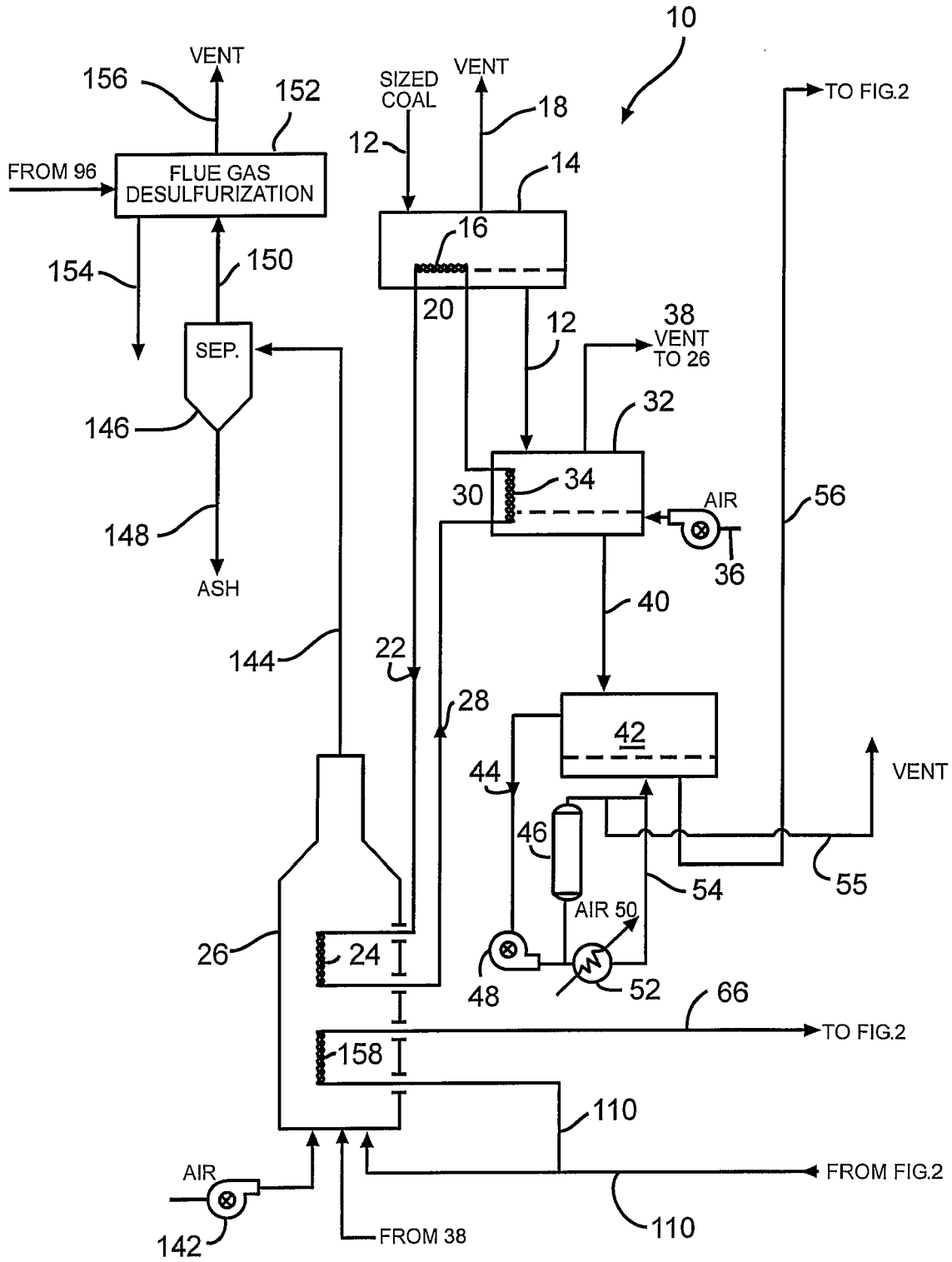
FIG. 1 is a schematic illustration of a process for treating agglomerating coal.

The process of the present invention pertains to treating agglomerating coal for the production of coal derived liquids (CDLs) and other higher value coal derived products, such as a high calorific value, low volatile, low ash, low sulfur coal (char), suitable for a variety of uses in industry, including metallurgical and power production and the like. Desired amounts of volatile components are removed from the resultant coal char through the use of low temperature carbonization (i.e., less about 1300° F.) so as to refine the solid product and to create a second revenue stream, the condensable coal liquids, which can be collected to produce syncrude. Further, desirable condensable hydrocarbon liquids are removed from the coal at more desirable concentrations than capable with conventional coal treating processes. In particular, the process combines the advantages of pyrolytic heating with an attemperated, high sensible heat oxygen deficient gas stream (sweep gas) coupled with indirect heating by passing a portion of the required heat through a rotating metal shell of a rotary pyrolyzer retort as described below. Pyrolytic heating is a desirable step in the process as coal feedstock is separated into a coal char and a vapor, which when passed through downstream condensers, such compounds can be separated into coal tar, water, and a fuel gas.

The process further combines the advantages of a pretreatment or chemi-sorption step (apparatus 32) in order to destroy or reduce the caking properties of the agglomerating coal in refining the coal to a coal char product having reduced ash and sulfur. The process is a dual zone pyrolysis process. During the first step, the bituminous coal is heated to a certain temperature, and during the second step, the coal is heated to a higher temperature than the first step. By using the dual zone pyrolysis process, By using the dual zone pyrolysis process, the indirect/direct pyrolytic heating step of the second pyrolysis step is optimized. A primary reason for indirect heating is that it maximizes the vapor pressure of the condensable hydrocarbon components and minimizes the carryover or lofting of fine coal or coal char particles. A further advantage of dual pyrolysis is to reduce the thermal requirement for the second pyrolysis step. The operating temperature in the second pyrolysis step is controlled to maintain a target or desirable volatile content in the coal char as some volatile in the coal char is desirable for both metallurgical and steam coal char product requirements.

It is to be understood that the process disclosed herein is suited for various types of agglomerating or highly agglomerating bituminous coal, particularly caking, coking coal having a free swelling index (FSI) of greater than 1.0.

In consideration of the figures, it is to be understood that for purposes of clarity certain details of construction are not provided in view of such details being conventional and well within the skill of the art once the present invention is disclosed and described herein.

Reduction of volatiles, including moisture, involves several thermal processing steps. Typically, agglomerating bituminous coals from surface mining operations are washed to remove mineral matter normally associated with these coals. Washing is dependent on large density differences between the organic coal substance and the mineral matter included therein with the as mined coal. After washing, a typical Western Kentucky bituminous coal will have a moisture content of nearly 12% by weight, even though the equilibrium moisture content is within a range of from about 7% to about 9%. Therefore, the as-received coal must be dried as the first step in the series of thermal steps described below.

Referring now to FIG. 1, a schematic illustration of a process 10 for treating various types of agglomerating coal 12 using indirect gas fired heating is shown. A stream of pulverized coal 12 is introduced into a fluidized bed dryer 14 with internal heating tubes having a heat exchange embedded tubular surface 16. Any suitable dryer can be used. The coal 12 is pulverized to a size passing 60 mesh prior to being introduced into the fluidized bed dryer 14. It should be understood that further size reduction of the coal to minus 200 mesh may be required for downstream separation of paramagnetic mineral elements. In one embodiment, the coal 12 is pulverized to a size within a range of from about minus 40 mesh to about minus 200 mesh. The heat transfer coils with thermal head (not shown) can range in temperature of from about 50° F. to about 100° F. with respect to intended dried coal temperature. The pulverized coal 12 can be dried in a fluidized bed dryer at a temperature below 400° F. The fluidized bed dryer 14 uses a combination of direct gas/solid heating plus indirect embedded heat transfer coils heating the coal to a temperature within a range of from about 300° F. to about 425° F. Excess moisture 18 is vented upstream from the fluidized bed dryer 14.

A heat exchange manifold 20, which functions as a heat transfer fluid conduit, is configured within a bottom portion of the fluidized bed dryer 14, from which a heat transfer fluid return flows downstream through conduit 22 into a heat exchanger 24 for heating the heat transfer fluid. Heat exchanger 24 is configured within a waste fuel gas combustor 26 for the combustion of gaseous $CH_4$, CO, $H_2S$, and other compounds. A heat transfer fluid conduit 28 exits from the heat exchanger 24 and flows upstream to a heat exchange manifold 30, which functions as a heat transfer fluid conduit, and is configured within a vessel such as a fluidized bed chemisorption apparatus 32. While a preferred apparatus 32 for the chemisorption process is a fluidized bed heater, an indirectly heated retort (not shown) having a retention time of at least 30 minutes can be used in the alternative. The fluidized bed chemisorption apparatus 32 includes a heat exchange embedded tubular surface 34 configured therein. An air blower 36 configured outside the fluidized bed chemisorption apparatus 32 supplies air to the coal 12 during the chemisorption treatment process. A vent 38 extends upstream from the fluidized bed chemisorption apparatus 32 and directs waste to the waste fuel gas combustor 26 for the combustion of gaseous carbon oxygen compounds, which compounds may be formed during the chemisorption treatment process.

Over a temperature range that coincides relatively closely with that of the intended active thermal decomposition, agglomerating bituminous coals pass through a transient plastic state in which they soften, swell and finally resolidify into a more or less distended cellular cake mass. These coals are referred to as caking coals, as opposed to those that do not become plastic on heating, which are referred to as non-caking coals. The caking or swelling nature of coals is evaluated using the empirical free-swelling test. The free-swelling index (FSI) is commonly used to rank various coals, the index having a range of from 1 to 10. Non-caking coals normally exhibit an FSI of 1 or less. In one embodiment, the substantially non-agglomerating coal has a FSI of 1 or less. Western Kentucky bituminous coals typically have an FSI of 4, or within a range of from about 1 to about 6. The plastic or coking nature of these bituminous coals leads to agglomeration of the coal particles when heated to the intended decomposition temperature range of from about 350° F. to about 1050° F. Agglomeration leads to sticking, which phenomenon causes plugging in the various heating devices. These caking properties are impediments to the intended thermal process and should be destroyed or counteracted, or at least greatly reduced.

Plastic properties of caking, coking coals when heated are generally known. Coal plastic properties are sensitive to changes in ambient conditions and are susceptible to modification. One or more of the ambient conditions described herein can be adopted to reduce the plasticity of agglomerating coals. These ambient conditions include: (1) increasing heating rates will increase the maximum Gieseler fluidity, dilatometric dilatation, and extent of free swelling, and simultaneously raise the temperatures at which characteristic plasticity parameters begin to manifest themselves; (2) prolonged pre-heating of the coal in an inert atmosphere at temperatures as low as 200° C. will progressively diminish fluidity, swelling, and related caking indices; (3) increasingly comminuting the coal—even a strongly caking coal with FSIs greater than 6-7.7 will yield only a barely coherent coke button if it is sufficiently finely pulverized and very slowly heated; (4) reducing the mineral matter content will greatly enhance the plastic properties of weakly and moderately caking coals with high ash contents, i.e., coals with FSIs between 3 and 5 and ash contents greater than 10%; (5) oxidizing (i.e., weathering during prolonged exposure to air) will quickly and progressively narrow the plastic range, reduce the maximum fluidity, and eventually completely destroy all caking propensity; and (6) suppressing all manifestations of plasticity by pyrolyzing the coal in vacuo or enhancing by heating the coal under elevated pressures. Even mild hydrogenation that seemingly does not alter the chemical structure of the coal to any great extent will cause converse effects, i.e., broaden the plastic range and increase swelling, fluidity, and the like.

Pilot plant experiments in accordance with the process disclosed herein have shown that pulverized, agglomerating coal sized to minus 60 mesh can be treated with chemisorption of oxygen and slow heating so as to convert the particulate dried coal to non-caking coal.

Exposure of freshly mined coal to air at ambient temperature conditions for as little as a few days will cause a marked deterioration of any caking properties. While not being bound by any theory, this deterioration of the caking properties is believed to be caused by two substantially concurrent processes—(1) progressive oxidative destruction of non-aromatic configurations, such as $CH_3$, $OCH_3$, or $(CH_2)n$, in the coal molecules, and (2) simultaneous chemisorption of oxygen at aromatic carbon sites.

In one embodiment, the coal is treated in a vessel with a gas stream having an oxygen content sufficient to form at least some oxides on a surface of the coal particles such that the oxides are sufficient to convert the coal into substantially non-agglomerating coal. In some embodiments, the oxygen content of the gas stream is sufficient to cause the coal to gain weight in an amount within a range of from about 0.5% to about 2.0% of the weight of the coal 12 when the coal is treated for a time of about 30 minutes at a temperature within a range of from about 400° F. to about 650° F. It should be understood that the vessel used for treatment can be either an oxidizing fluidized bed vessel 32 or an oxidizing rotary retort (calciner) of the type described below.

Following treatment of the coal by chemisorption, the chemisorbed or treated coal 40 can be transferred to either a fluidized bed, or, preferably, a dual zone pyrolysis, for pre-heating in accordance with the process of the present disclosure. It is advantageous to separate the two stages of the dual zone pyrolysis process for several reasons, including: (1) to reduce the coal mass flow heating requirement for the indirect heating required for the second stage; (2) to reduce the sensible heat required for the indirect second stage as coal will enter at about 900° F.; (3) to increase the partial pressure of the condensables released in the second stage, i.e., C5+ and the like; (4) to burn combustible components released in the first zone in a slipstream combustor; and (5) to separately treat effluent for removal of mercury using activated carbon.

In one embodiment, the first zone pre-heats the coal to a temperature within a range of from about 550° F. to about 900° F. in either a pre-heat rotary retort 42 or a pre-heat fluidized bed vessel (not shown). It is contemplated that the first zone will raise the coal temperature to a temperature within a range of from about 550° F. to about 900° F. so as to both pre-heat and produce $CO_2$ by partial pyrolysis. The $CO_2$ is used as a recycle fluidizing gas (i.e., off gas) 44, partially slipstream passing through a combustor 46 and prior to venting so as to combust any hydrocarbons or CO that may be involved in the partial pyrolysis process. Combustion of any fuel gases other than $CO_2$, including CO, $CH_4$ and the like, will provide all or a portion of the thermal energy required for pre-heating and partial pyrolysis of the coal in the pyrolyzer 42. It is further contemplated that the temperature in the first zone is controlled to about 550-900° F. so as to remove about 2% to about 10% by weight of coal volatile components from the treated coal 40 while allowing desirable volatiles to remain with the coal particles.

In certain embodiments, the temperature of the first zone is no greater than 900° F., which is the temperature incipient for release of condensable coal volatile vapors.

In a further embodiment, the pre-heating step removes volatiles from the treated coal and includes withdrawing off gases (i.e., $CO_2$, CO, $CH_4$ and the like) 44 from a pre-heat rotary retort 42 or a pre-heat fluidized bed vessel (not shown), and then combusting the volatiles in the off gases in combustor 46 and transferring thermal energy from the combustion to the pre-heating step 42. The off gases 44 pass through a recirculation fan 48 before flowing either through a slipstream combustor air supply fan 50 prior to combustion or through a heat exchanger 52 to provide on gas 54 to the first pyrolysis retort 42. The on gas 54 and first stage coal char 56 from the pyrolyzer 42 can be vented at 55 as shown in FIG. 1.

Figure 2:
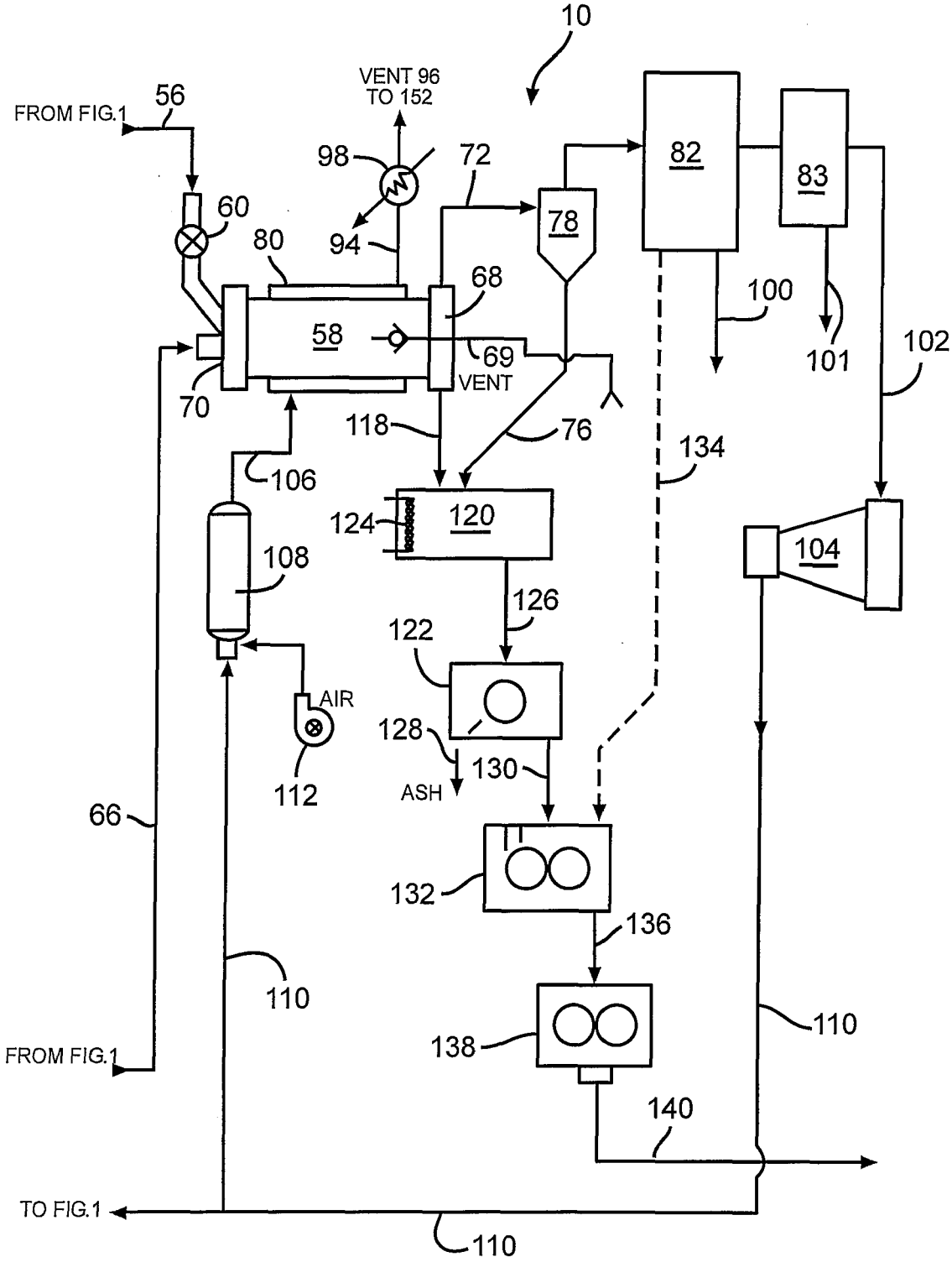
FIG. 2 is a schematic illustration of a continuation of the process of FIG. 1 for treating agglomerating coal.

Referring to FIGS. 1 and 2, following pre-heating of the treated coal 40 in the first zone, the first stage coal char 56 is transferred into a chamber or pyrolytic rotary retort 58 for the second pyrolysis step. The chamber can be any vessel suitable for heating coal by convection gases as well as heating indirectly by radiation and conduction. The dried and pre-heated coal 56 may be pre-sized to a range between 40 mesh and 200 mesh prior to being charged into the pyrolytic retort 58, but other sizes can be used. A rotary valve 60 isolates and controls the flow of the incoming coal char 56, which is directed continuously into the rotary retort chamber 58.

Various reactions in the second pyrolysis step occur at a temperature within a range of from about 900° F. to about 1200° F. in accordance with the process of FIGS. 1 and 2. These reactions include the release of coal volatiles, decomposition of organic sulfur forming $H_2S$, COS, and $CS_2$, conversion of pyrite ($FeS_2$) to paramagnetic pyrrhotite ($Fe_7S_8$), and conversion of other iron oxides to paramagnetic oxide forms. The treated coal char 56, which enters the retort 58, includes pyrite and hematite ($Fe_2O_3$), and the pyrolyzing of the coal char in the second zone causes the conversion of pyrite to pyrrhotite, and the conversion of hematite to magnetite ($Fe_3O_4$).

The rotary retort 58 used for the combined direct/indirect pyrolytic heating process may be selected from a type of heat transfer device for the indirect thermal processing of bulk solid materials commonly referred to as a rotary calciner. The rotary calciner consists principally of an alloy rotary shell 62, enclosed in and indirectly heated on its exterior in a stationary furnace. The process material (i.e., coal) 56 moves through the interior of the rotary shell 62, where it is heated through a combined radiative and convective/conductive mode of heat transfer through the rotary shell wall 64. Operating temperatures of up to 2200° F. can be achieved. Rotary calciners can be small pilot-scale units, or full-scale productions units as large as 10-12 feet in diameter with a heated length of up to 100 feet. Units can be heated by a variety of fuels, such as gas (FIGS. 3-4), or by electric-resistive heating elements (see FIG. 5). Waste heat and/or external heat sources can also be accommodated for rotary calciners.

It is contemplated that the rotary retort 58 is of sufficient length and capacity so as to provide pulverized coal particle residence time within a range of from about 15 minutes to about 25 minutes, which time is desirable for conversion of the non-magnetic pyrite ($FeS_2$) to paramagnetic pyrrhotite ($Fe_7S_8$) and for reduction of the non-magnetic iron oxides to paramagnetic magnetite. In some embodiments, the residence time is no greater than 22 minutes, which residence time will not cause reduction of the newly formed magnetic iron oxides, forming therefore undesirable non-magnetic wustite (FeO).

Materials of construction of the rotary shell 62 are selected for high-temperature service, corrosion resistance, and compatibility with process materials. The rotary shell 62 may be fabricated from a wrought heat and corrosion-resistant alloy steel. For example, Type 309 alloy is the nominal material for indirectly heated rotary calciners operating in the 1300° F. metal temperature range. A variety of features and auxiliary equipment is available to accommodate many process requirements.

Rotary calciners are ideal for specialized processing due to the indirect heating mechanism. As the heat source is physically separated from the process environment, specific process atmospheres can be maintained. Processes requiring inert, reducing, oxidizing, or dehumidified atmospheres, or those with a solids/gas phase reaction can be accommodated. Depending on the process requirements, rotary calciners can operate under positive or negative pressure, and a variety of seal arrangements are available. Internal appurtenances affixed to the rotary shell interior 62 can be employed to promote uniform heat transfer and exposure of the material to a process gas (i.e., sweep gas) 66. The indirect heating also allows for temperature profiling of the process, which provides the capability of maintaining the material temperature at a constant level for specific time periods. Multiple temperature plateaus can be achieved in a single calciner unit in this manner.

Indirectly heated rotary calciners are well known to those knowledgeable with thermal heating of bulk free flowing solids. A typical rotary retort suitable for heating coal to 1200° F. is manufactured by The A. J. Sackett & Sons Co. (Baltimore, Md.) and it is rated for transfer of 6,240,000 BTU/hour having a surface area of 602.88 $ft^2$ of indirect rotary calciner surface and a heat flux in the range of about 10,350 BTU/hr/$ft^2$.

For a heating retort having a combination of indirect and direct heating, when indirect heating is in the range of about two thirds of the total, the one third balance of heat must be supplied by a flow of gases (sweep gases 66) passing into contact with the coal 12. One method of providing sweep gases 66 is to pass a stream of oxygen deficient gases containing both inert and combustible components through an indirect heat exchanger in which the temperature of the gas stream may be heated and/or cooled so as to provide the optimum temperature and composition. Another method of providing sweep gases 66 is to admit the oxygen deficient gas stream containing both inert and combustible components into a combustion chamber with oxygen or combustion air to release sensible heat. The gas stream serves a second purpose, other than partial heat input, serving as a sweep gas to cause the outflow of gases released in the pyrolytic treatment of the continuously flowing dried and pre-heated coal entering the system.

An advantage of the combined direct/indirect pyrolytic heating process is the co-current flow configuration. The temperatures of the heated coal char 56 and the sweep gases containing the gaseous volatiles having been pyrolytically released from the solid coal char can be brought essentially to equilibrium at the discharge end 68 of the rotating retort 58 via a steam quench 69. Steam quench 69 at the exhaust of retort 58 reduces the gaseous exhaust temperature. The heated coal char 56 can be controllably released at the discharge end 68 of the retort 58 via a product char outlet rotary valve (not shown). The temperature differential between the coal char 56 and the sweep gases 66 at the point of desired pyrolysis process completion is in the range of from about 100° F. to about 200° F. In one embodiment, the temperature differential is about 150° F. Other ranges can be used.

Although in the embodiment shown in the drawings the flow of coal char 56 and sweep gases 66 is co-current, it is to be understood that the flow could be counter-current.

Another advantage of the combined direct/indirect pyrolytic heating process is the relatively substantial permissible thermal temperature differential at the charge end 70 of the retort 58. Differential temperatures between the coal char 56 and the sweep gases 66 at the charge end may be in the range of about 650-750° F., or higher, resulting with an overall retort log mean differential temperature of about 300-400° F.

A further advantage of the combined direct/indirect pyrolytic heating process is found in the fact that the concentration of condensable volatiles is increased when compared to a direct heating process employing attemperated high sensible heat oxygen deficient gas for 100% of the heating. For a conventional 100% direct gas heated system, processing a dried and pre-heated coal, the condensable hydrocarbon concentration is typically about 6.2% of the gaseous stream 72 exiting from the pyrolyzer 58. On the other hand, with 100% indirect heating, the condensable component is about 51.3% of the total gas, including water of pyrolysis released when pyrolytically processed at 1200° F. For a combined indirect/direct heated system with 50% direct gas and 50% indirect heating, the condensable hydrocarbon component is expected to be in the range of about 27.4% of the gas stream 72 leaving the retort 58.

Optional internal lifting flights 74 (FIGS. 3 and 5) attached to the inner wall 64 of the pyrolytic retort 58 may be used to improve the mixing of coal particles 56 in transition from the initial temperature to the final desired temperature and the efficiency of gas-solid contact. As the retort 58 rotates, the internal lifting flights 74 serve to lift the coal particles 56 from the moving bed and subsequently allow them to fall as a cascade back to the surface of the axial flowing coal bed. In some rotary calciner applications, the lifting flights are arranged so as to promote continuous lifting and falling of the particles being thermally treated. Although gas-solid contact is improved, the repeated lifting and falling of the particles undesirably may result in the production of large amounts of fines and dust. The dust and fines may become entrained in the sweep gas stream and be exhausted with the desirable vapors and gases released in the pyrolytic process. Optionally, the internal flights 74 may be staged so as to provide the desired gas-solid contact with a minimum formation of fines 76 and dust prior to the coal fines being filtered via a mechanical gas/fines filter 78. With staged internal flights 74, the bed of coal char particles 56 being treated in the retort 58 will experience one or more cascades according to the number of stages required to achieve the desired mixing of coal char particles 56 without causing undue particle dimunitization.

In some embodiments of the rotary pyrolytic retort 58, the coal bed 56 moves in a rolling mode according to Hencin's classification. In this mode, the bed of coal char particles 56 can be considered as those rolling on the surface as opposed as to those that are embedded. Those on the surface roll due to the effect of gravity. This surface layer is commonly referred to as the "active layer". These particles 56 receive heat from the sweep gases 66 by convection. The oxygen deficient sweep gas 66, containing no greater than about 1% by volume oxygen, is at a higher temperature than the temperature of the coal char 56 so that heat is supplied to the coal. In other embodiments, it is contemplated that the oxygen deficient sweep gas 66 contains no greater than about 2% by volume oxygen. The active layer is enhanced by virtue of staged lifters 74 so as to promote additional internal convective heat transfer from the sweep gas 66 to the coal char particles 56. Beneath the active layer is the mass of the coal bed 56, which is in contact with the metal wall, receiving indirect heat by conduction, as shown in FIGS. 3 and 5.

Figure 3:
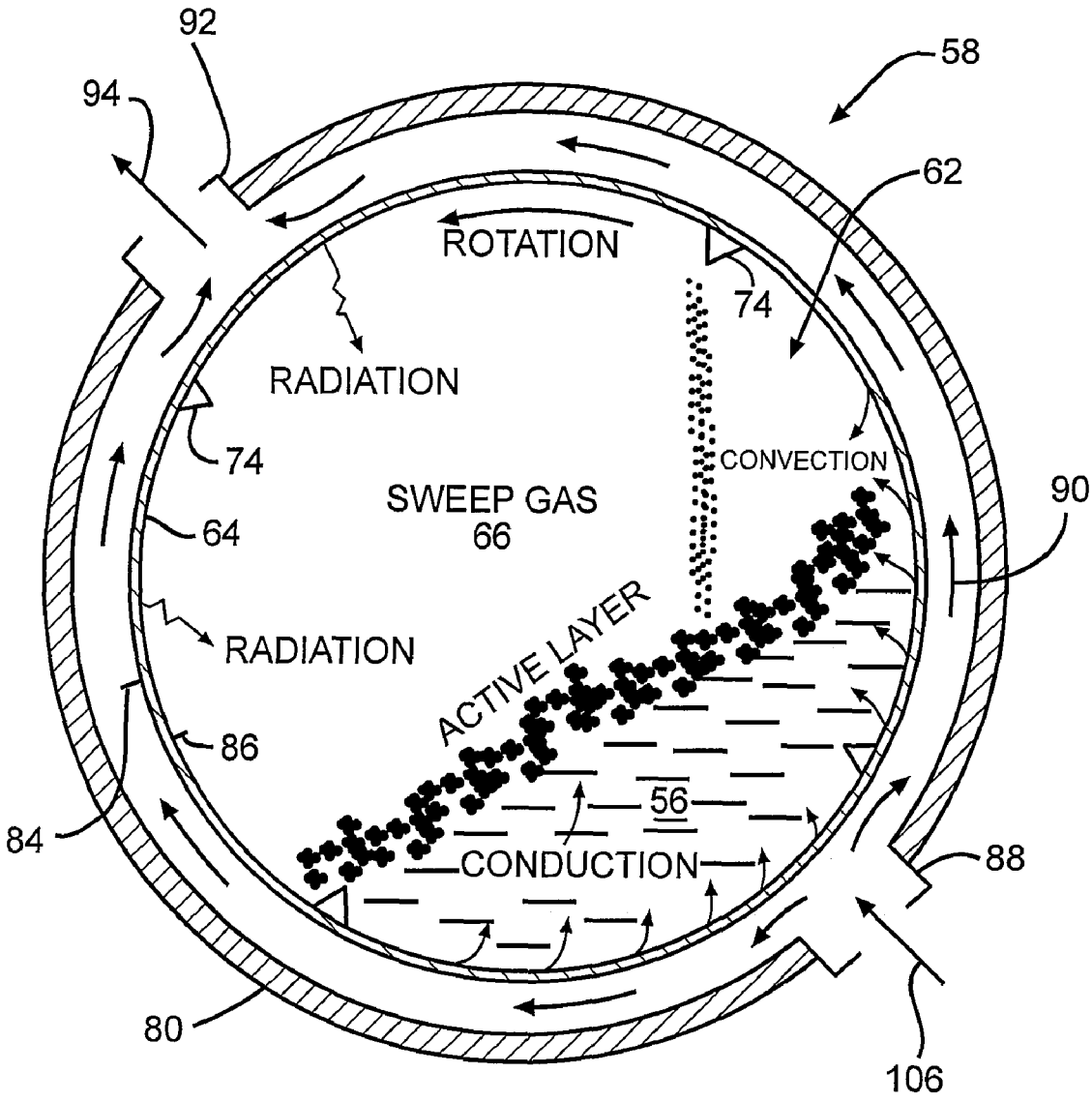
FIG. 3 is an enlarged, schematic cross-sectional view of a gas-heated retort used in the process of FIGS. 1 and 2.
Figure 5:
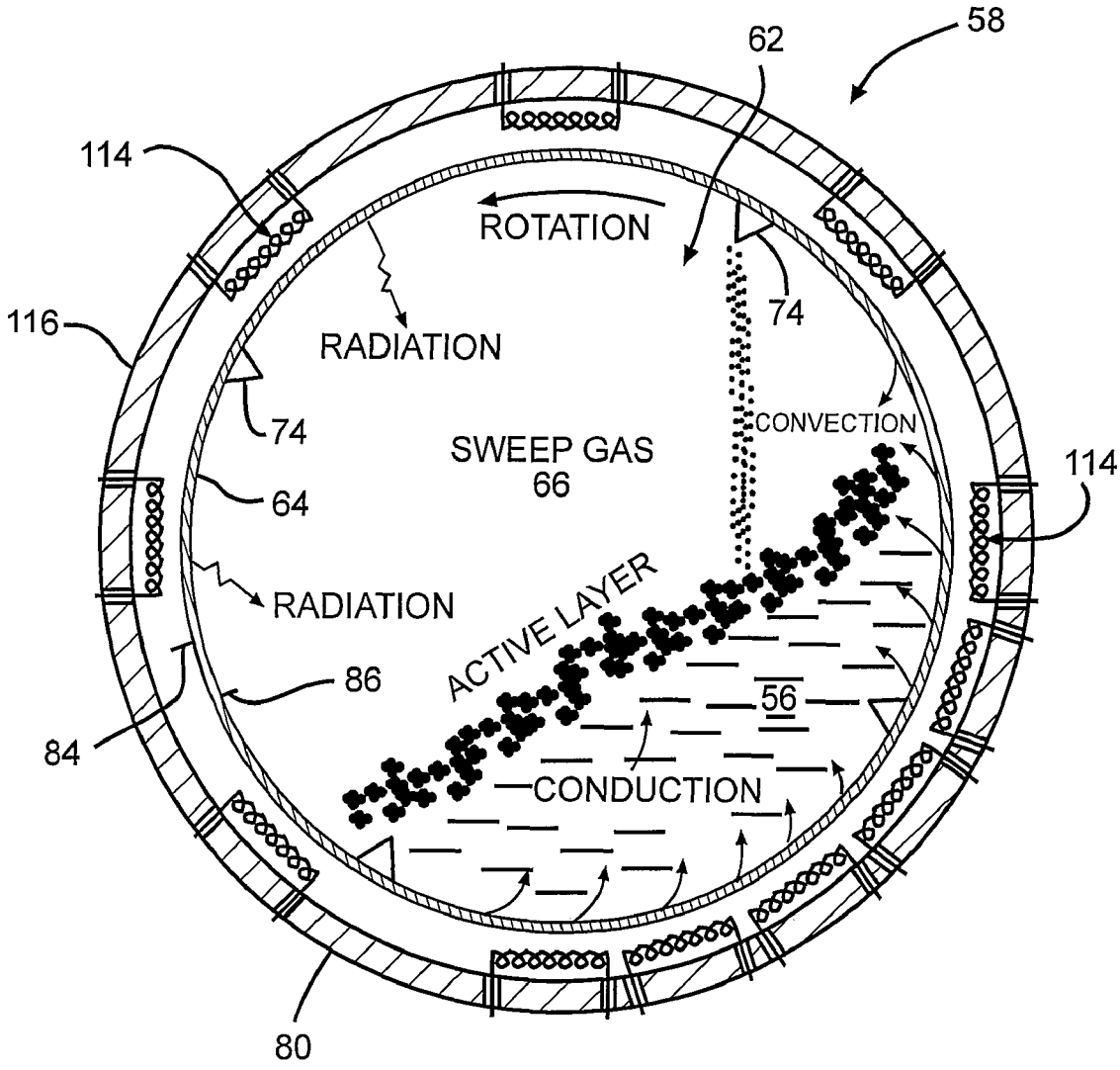
FIG. 5 is an enlarged, schematic cross-sectional view of an electrically heated retort used in the process of FIGS. 1 and 2.

As schematically illustrated in FIGS. 3 and 5, the heat transfer between the sweep gas 66 and the solid coal char particles 56 involves radiation, convection, and conduction. Internal heat enters the process by cooling of a sweep gas stream consisting of an oxygen deficient high sensible heat gas 66, entering co-currently at a temperature in the range of about 1200° F. to about 1800° F. and leaving the retort 58 at a temperature in the range of about 1100° F. to about 1300° F. In one embodiment, the sweep gas 66 is introduced at a temperature of about 1700° F. and the sweep gas is discharged at a temperature of about 1200° F. For a sweep gas stream of 40,000 lbs/hour (approximately 67.3% $H_2O$, 2.9% $N_2$ and 29.2% $CO_2$) having a combined specific heat of approximately 0.38 BTU/lb-° F., the process thermal component received from the sweep gas will be in the order of about 6,500,000 BTU/hour. There may be $H_2S$ present also. In one embodiment, the entering temperature is limited to counter the water gas reaction and coal overheating. For the co-current flow pattern, with the coal char 56 entering at a preheated temperature in the range of about 550-650° F., the sweep gas 66 is cooled by radiation and convection rapidly, perhaps in a matter of one second or less, to a mean temperature in the range of about 1200-1300° F. The coal char bed 56 provides a significant heat sink in the order of 32,000,000 BTU/hour when at a temperature in the range of from about 900° F. to about 1200° F. Further, the sweep gas 66 receives heat from the externally heated rotating metal retort shell 80, as the sweep gas 66 and vapors are transferred from the entry end 70 of the retort 58 to the discharge end 68. The heat released by the sweep gas, 6,500,000 BTU/hour, represents 20% of the nominal 32,000,000 BTU/hour required for pyrolysis of 360,000 lbs/hour of dried and pre-heated bituminous coal. In certain embodiments, when the intended pyrolysis temperature is about 1150° F., the sweep gas 66 will enter the retort at about 1650° F.

In one embodiment, the proportion of heat supplied to the coal char 56 by the sweep gas 66 is less than 40% of the total heat supplied to the coal char 56. In further embodiments, at least 80% of the sweep gas 66 includes $CO_2$ and $H_2O$, and the mass ratio of sweep gas 66 to the coal char 56 supplied into the chamber 58 is less than about 0.50. In still further embodiments, at least 80% of the sweep gas 66 includes $CO_2$ and $H_2O$, and the mass ratio of sweep gas 66 to the coal char 56 supplied into the chamber 58 is less than about 0.25.

A further advantage of the high specific heat sweep gas 66 is the relatively high emissivity in accordance with the process of the present invention. Nitrogen ($N_2$) is a symmetrical molecular gas, which does not contribute to the radiative component of the gas stream. Nitrogen ($N_2$), Oxygen ($O_2$), Hydrogen ($H_2$) and dry air have symmetrical molecules and are practically transparent to thermal radiation—they neither emit nor absorb appreciable amounts of radiant energy at temperatures of practical interest, i.e., 1000-1500° F. On the other hand, radiation of heteropolar gases and vapors such as $CO_2$, $H_2O$, $SO_2$ and hydrocarbons are of importance in heat transfer applications. In one embodiment, the intended sweep gas, 40,000 lb/hour of gas having a constituency of approximately 67.3% $H_2O$, 2.9% $N_2$ and 29.2% $CO_2$, supplied into the chamber has an emissivity within a range of from about 0.5 to about 0.7, optimally with an emissivity of about 0.65. There may be $H_2S$ present also. When both $CO_2$ and $H_2O$ are present in high concentrations, the emissivity can be estimated by adding the emissivities of the two components. The primary components of the composite emissivity with a beam length of 9.0 feet are about 0.45 from water vapor and about 0.20 from the carbon dioxide, with an internal retort pressure within a range of from about 0.85 to 1.3 atmospheres or, alternatively, a range of from about 1.05 to 1.20 atmospheres, and optimally at about 1.15 atmosphere. The optimal internal retort pressure enhances the downstream oil recovery process as the downstream oil collection apparatus (absorption apparatus 82) can be smaller in cross-section, i.e., absorption apparatus can be a lesser diameter, which contributes to a more effective absorption and a lower cost.

The heating of the coal char 56 by the sweep gas 66 and by the indirect heating from the chamber 58 causes condensable volatile components to be released from the coal into the sweep gas. The temperature of the retort 58 can be controlled so as to produce pulverized coal char 56 having a volatile component within a range of from about 10% to about 25% by weight. In one embodiment, the temperature of the coal char 56 within the chamber 58 is raised to a temperature within a range of from about 1200° F. to about 1500° F. in order to improve removal (e.g., volatilization) of organic sulfur.

Optional seals (not shown) can be provided to restrain gas and dust flow at the charge 70 and discharge end 68 of the pyrolytic retort 58. The seals are typically mechanical in nature with a riding/wear component, typically graphite or the like. The seal components are restrained with springs so as to maintain the seal between the static end housings and the rotating cylindrical metal shell 62. Other types of seals can be used.

For a typical pyrolytic coal heating process, the heat required to cause a continuously entering stream of 360,000 lbs/hour of bituminous coal previously dried and pre-heated in the range of about 850-900° F. to be pyrolyzed has been determined by heat balance and computation to be about 32,000,000 BTU/hour. The specific heat requirement is approximately 95 BTU/lb-dried coal entering at 900° F. For the typical pyrolytic coal heating process, having an indirect heating effective surface area of 2880 $ft^2$, with a heat flux rate of 9,000 BTU/hr/$ft^2$, the heat supplied is therefore about 25,500,000 BTU/hr. The indirect heating component would be in the order of 25,500,000 BTU/hr divided by the total requirement of 32,000,000 BTU/hr or 80% of the total. Other rotary calciners examined show heat flux rating of from about 4000 BTU/hr/$ft^2$ to 12,000 BTU/hr/$ft^2$ with 10,000 BTU/hr/$ft^2$ being typical for the present embodiment.

It should be understood that a very short gaseous residence time in the retort is desirable to avoid thermal cracking of the high molecular weight hydrocarbon vapors at temperatures of about 950° F. and higher. For temperatures in the 950° F. to 1,300° F. range, gaseous residence times of five seconds or less are desirable to avoid measurable cracking of the desirable hydrocarbons. Conversely, with gaseous residence times of one to two seconds, hydrocarbon cracking requires temperatures in the 1,650 to 1,850° F. range. For a 10-foot diameter retort having a length of 100 feet, the gaseous interior volume is calculated to be 5,500 cubic feet (30% filled with coal/char). With a sweep gas flow of 75,000 actual cubic feet per minute (measured at the exit and including the make gas, i.e., gas evolved during pyrolysis), the residence time is in the range of about 0.25 seconds. In one embodiment, the average gaseous residence time within the retort 58 is within a range of from about 0.2 second to one second. In an alternative embodiment, the average gaseous residence time within the retort 58 is less than about one second.

FIG. 3 illustrates an enlarged, schematic cross-sectional view of a gas-heated retort 58 used in accordance with the process of the present invention. In this embodiment, the rotary shell wall 64 can be fitted with an external heat exchange enhancing device 84 and an internal heat exchange enhancing device 86, which can be referred to as extended heat exchange surfaces, akin to fins on a heat exchanger surface. The rotary retort inner shell 62 is mounted for rotation within a cylindrical outer shell 80. The outer shell 80 includes a heat source (e.g., gas combustion products) for supplying indirect heat to the inner shell 62. At least one indirect heating gas inlet 88 is configured within the outer shell 80 for entry of the gas 90. At least one indirect heating gas outlet 92 is configured within the outer shell 80 for removal of the gas 90. The partially heat depleted oxygen deficient high sensible heat gases 94 are vented 96 from the outer shell 80 of the retort chamber 58 and passed through a gas/fluid heat exchanger 98 to the flue gas desulfurization unit 152.

Figure 4:
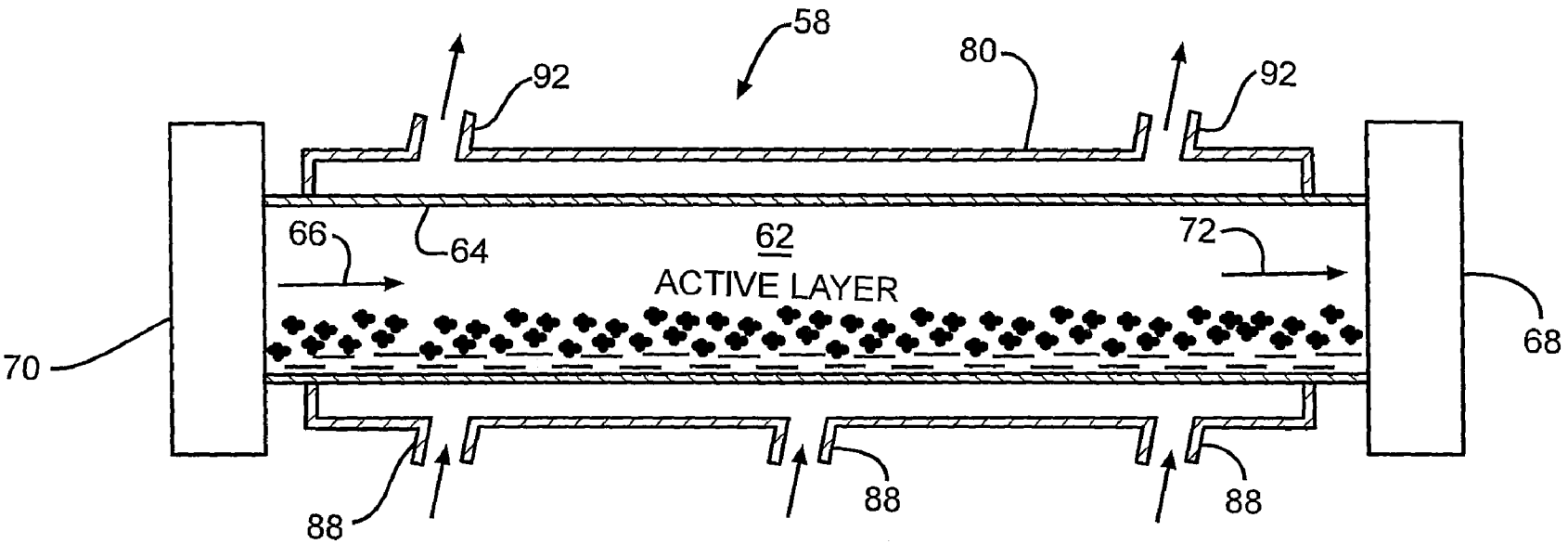
FIG. 4 is an enlarged, schematic side view of the gas-heated retort of FIGS. 1 and 2.

FIG. 4 illustrates an enlarged, schematic side view of the gas-heated retort 58 of FIG. 2 described above. In this embodiment, the sweep gas 66 is continuously supplied into one end of the chamber 58 at the charge end 70 and removed from another end of the chamber at the discharge end 68, and the average velocity of the sweep gas is less than 900 feet per minute. In a further embodiment, when the proportion of the heat supplied to the coal by the sweep gas is less than 40% of the total heat supplied to the coal, the sweep gas exiting the chamber 58 has a condensable hydrocarbon content of at least 25% by weight. In still another embodiment, the coal is heated in the retort to a temperature within a range of from about 900° F. to about 1100° F. so that the sweep gas exiting the retort has a condensable hydrocarbon content of at least about 25% by weight Volatile components $H_2S$, $CS_2$, and COS, are removed from the retort 58 with the sweep gas 66.

Following the removal of the sweep gas 66 from the chamber 58, the sweep gas is appropriately treated to remove condensable components of the coal char 56, including hydrocarbons, water vapor, and other volatile compounds, in accordance with the process 10 schematically illustrated in FIGS. 1 and 2. The sweep gas 66 is passed into a mechanical filter 78 to separate solid coal char fines 76 from the desirable gaseous hydrocarbon compounds. The coal fines 76 can be controllably released from the filter 78 via a fines outlet rotary valve (not shown). The gas stream 72 is next passed into a single- or multi-stage quench tower absorber system 82 complete with single or multiple heat removal stages to separate the desirable condensable hydrocarbon compounds 100 and other compounds singularly or in a multiplicity of fractions as may be required to recover the desirable coal derived liquids. A non-condensed process derived gaseous fuel 102 then exits from the absorption system 82, passes into an absorber 83 to remove any hydrogen sulfide ($H_2S$) 101, and flows into a downstream process derived gaseous fuel compressor 104. Hydrogen sulfide can be removed from the gaseous fuel using any suitable sulfur remover such as LO-CAT technology available through Gas Technology Products LLC (Schaumburg, Ill.).

Optionally, the remaining gaseous compounds and water vapor can be passed through a final stage quench tower (not shown) to remove a portion of the contained water vapor.

Referring to FIGS. 3 and 4, a desirable method of supplying the heat for indirect heating of the retort 58 is from combustion of some of the non-condensed gaseous coal-derived fuel 102. Some of the compressed, non-condensed gaseous coal-derived fuel 110 is ducted to a combustor 108 for combination with an auxiliary fuel, if necessary, and air and/or oxygen to form products of combustion 106 supplied to the retort 58. Combustion air can be added to the combustor 108 via a combustion air blower 112.

It is further contemplated that increased energy efficient volatilization and desorption cooling process stages can be realized by using less sweep gas, replacing the convective heat transfer of the sweep gas wholly or partially with indirect heating of the coal being treated in the pyrolytic retort 58. In one embodiment, the condensable hydrocarbon (C5+) components represent about 50% (25-75 wt %) of the volatiles evolved in the pyrolysis process. At this concentration, the condensation temperatures are more representative of the respective boiling points and the volatile hydrocarbons can be efficiently cooled, condensed and separated in a multi-stage downstream absorption system (shown as a single-stage absorption system 82 in FIG. 2) into groupings of specific desirable boiling point fractions (condensed hydrocarbons shown as element 100 in FIG. 2).

Referring to FIGS. 1 and 2, compressed process derived gaseous fuel 110, after having passed through the process derived gaseous fuel compressor 104, flows upstream through the waste fuel gas combustor 26 (FIG. 1) while an air blower 142 supplies air for the waste fuel gas combustor. Combustor flue gases 144 flow upstream into a mechanical particulate separator 146 for the removal of ash fines 148 and sulfur. Ash depleted flue gases 150 are directed from separator 146 into a flue gas desulfurization apparatus 152 creating an effluent 154 containing sulfur originating as organic sulfur in coal flows downstream. Cleansed flue gases 156 are vented upstream from the flue gas desulfurization apparatus 152.

It is contemplated that the process derived gaseous fuel 110 may be used as a sweep gas 66 for the second zone pyrolysis process. The process derived gaseous fuel 110 flows into the waste fuel gas combustor 26 in which the gaseous fuel 110 is heated by a heat exchanger 158. After appropriate heating in the combustor 26, the sweep gas 66 flows upstream into the second zone pyrolytic retort 58.

After the second zone pyrolysis process is completed and the pulverized coal has been transformed into coal char (containing paramagnetic components and other ash components) 118 by evolution of the coal volatiles, and products of organic sulfur decomposition and the magnetic susceptibilities of the inorganic sulfur in the resultant char have been enhanced, the coal char can be cooled via a coal char cooler 120 and transferred to a dry magnetic separation device 122. The coal char cooler 120 is configured to have a heat exchange embedded tubular surface 124. The coal char 118 enters the char cooler 120 at a temperature within a range of from about 950° F. to about 1150° F. and is cooled to a temperature within a range of from about 250° F. to about 350° F. Other temperatures are possible. The coal char cooler 120 can be a fluidized bed cooler having internal embedded coiling coils. The coolant used in conjunction with the coal char cooler 120 can be a commercial heat transfer fluid of the type manufactured by Solutia, Inc. (St. Louis, Mo.) called Therminol. Optionally, the coolant is circulated to an upstream heating/drying unit, where the heat is transferred to the incoming coal. The intended purpose for the cooling step is to remove sensible heat from the solid, and a secondary purpose is to quench the pyrolysis process, which process continues in the hot char as it enters the coal char cooler 120. Exhaust gases from the cooler 120 are treated in the waste fuel gas combustor 26.

The cooled coal char 126 can be passed through a dry magnetic separator 122 so as to remove at least a portion of the magnetic pyrrhotite and magnetite to produce a beneficiated coal char. Dry magnetic separation of coal ash, sulfur, and mercury from comminuted coal is known in the art. The cooled coal char 126 can be magnetically treated by using a conventional dry magnetic separator of the type manufactured by the EXPORTech Company, Inc. (Pittsburgh, Pa.). A preferred dry magnetic separator is an open gradient, free flow, Para Trap separator capable of separating very weakly magnetic materials, such as iron pyrites, which contribute to the sulfur and trace metals such as mercury and arsenic in some coals so treated. It has been shown with two passes of the coal char through the Para Trap separator, reductions of 28% ash, 78% pyritic sulfur, 31% arsenic, and 72% mercury were achieved, when used in accordance with the process disclosed herein.

It should be understood that ash removal and carbon carryover results vary with the degree of comminution afforded the raw coal, the iron content, and the degree of magnetic conversion attained in the pyrolysis chamber. The actual retention time and temperature experienced by the coal in the thermal reduction process can affect the ash/sulfur removal results.

In one embodiment, a further reduction of other iron oxide materials occurs in the pyrolysis process, such that this mineral matter is transformed into magnetite, which mineral matter is subsequently removed by the same dry magnetic separation means used to remove the inorganic sulfur. Magnetic ash minerals (containing inorganic sulfur and iron oxides) 128 exit the dry magnetic separator 122 while coal char 130 flows downstream into a mixer 132 in which the coal char is combined with a centrifuge output (containing coal tar, char fines, and a suitable binder) 134 for briquetting. A desirable ingredient for briquetting pulverized coal char is a binder. In one embodiment, the binder is coal tar from the liquid recovery portion of a coal beneficiation plant.

It is contemplated that coal tar is condensed and collected prior to its use as a binder for briquetting of the coal char. Heat is recovered from hot coal tar using an external heat exchanger and is directed to the fluidized bed dryer 14 for drying the pulverized coal 12. Overhead gases from a coal tar collection apparatus (not shown) contain various fuel components, including $C_3H_8$, $CH_4$, CO and the like, and gaseous sulfur compounds, including $H_2S$, $CS_2$, and COS. The overhead gases can be used for fuel for the drying, pre-heating, and pyrolysis functions. The effluent from the heating units contain $SO_2$, which can be removed using conventional scrubber technology.

Condensed hydrocarbon vapors exiting the second pyrolysis zone contain solid coal char fines. The liquid recovery system includes a centrifuge for separation of highly viscous coal liquids and coal char fines. This stream of viscous coal tar containing coal char fines (centrifuged bottom portions) can be pumped into a mixer or blender where the coal tar, char fines and product coal char, are intermittently mixed and blended prior to briquetting. The nominal addition of coal tar may be equal to about 3% of the product coal char. The coal tar adds to the volatile content in the product briquettes. The addition of coal tar can be adjusted as might be necessary to correct for over or under removal of volatiles in the pyrolysis process. The beneficiated coal char and binder 136 can be briquetted using any suitable apparatus, such as a conventional roll briquetting machine 138 of the type manufactured by K.R. Komarek, Inc. (Wood Dale, Ill.). The product coal char briquettes 140 formed in accordance with the process disclosed herein are synthetic metallurgical grade, high calorific value, low sulfur coal. The product briquettes 140 can be transshipped using traditional coal transport means.

In the alternative, following the dry magnetic separation step, the beneficiated coal char is suitable for transfer to a pulverized coal power generation facility. Transfer may be accomplished by using an inert pneumatic transfer means. A further technique is to use inert, enclosed gondola rail cars for long distance transshipment.

FIG. 5 is an enlarged, schematic, cross-sectional view of an alternative embodiment of the process 10 of the present invention in which electric resistance heating is the indirect heating source of the outer shell 80 of the rotary retort 58. Typically, electric power is a more costly form of energy, when compared with common industrial fuels. On the other hand, use of electric resistance heating is nearly 100% efficient, as compared to gas fired systems, which are in the range of about 55 to 60% efficient when exhausted at 1300-1500° F. Electric resistance heating equipment is generally less costly than a gas fired heating system of the same effective heat input. A further advantage of electric resistance heating is the ease of setting up multiple heat control zones along the length of the retort and profiling of the heating elements so as to effectively match input and demand for a rotary retort embodiment adapted for pyrolysis of various types of dried and pre-heated coal. In some embodiments, the rotary retort 58 can be subdivided into different indirect electric resistant heat zones.

It is to be understood that when electric resistance heating is the indirect heating source of the outer shell 80 of the rotary retort 58, elements 106, 108, and 112 shown in FIG. 2 are not applicable for such alternative embodiment.

Referring further to FIG. 5, the rotary shell wall 64 can be fitted with an external metal extended surface 84 and an internal metal extended surface 86. The rotary retort inner shell 62 is mounted for rotation within a cylindrical outer shell 80. A plurality of electric resistance heating elements 114 are selectively positioned around an inner wall 116 within the outer shell 80 of the rotary retort 58.

The present disclosure is further defined in the following Examples, in which all parts and percentages are by weight and degrees are Fahrenheit, unless otherwise stated. It should be understood that these Examples, while indicating preferred embodiments of the invention, are given by way of illustration only. From the discussion herein and these Examples, one skilled in the art can ascertain the essential characteristics of this invention, and without departing from the spirit and scope thereof, can make various changes and modifications of the invention to adapt it to various usages and conditions.

Example I

The content of the resultant coal char product according to the process described herein is shown in Table 1 below. It is to be understood that the composition of the resultant coal char product is very much a function of the feed coal, and laboratory testing is needed to verify yields for each product for various types of bituminous coals.

TABLE 1

Pulverized Coal Char Characteristics

| | As Received Coal | Pulverized Char Product |
|---|---|---|
| Moisture | 6.15 | 1.50 |
| Ash | 9.78 | 10.50 |
| Volatile | 39.45 | 18.00 |
| Fixed Carbon | 44.62 | 70.00 |
| | 100.00 | 100.00 |
| Sulfur | 4.09 | 1.76 |
| Pyritic | 2.06 | 0.81 |
| Sulfatic | 0.14 | 0.20 |
| Organic | 1.89 | 0.75 |
| Heating Value | 12,170 BTU/lb | 13,150 BTU/lb |

Example II

Figure 6:
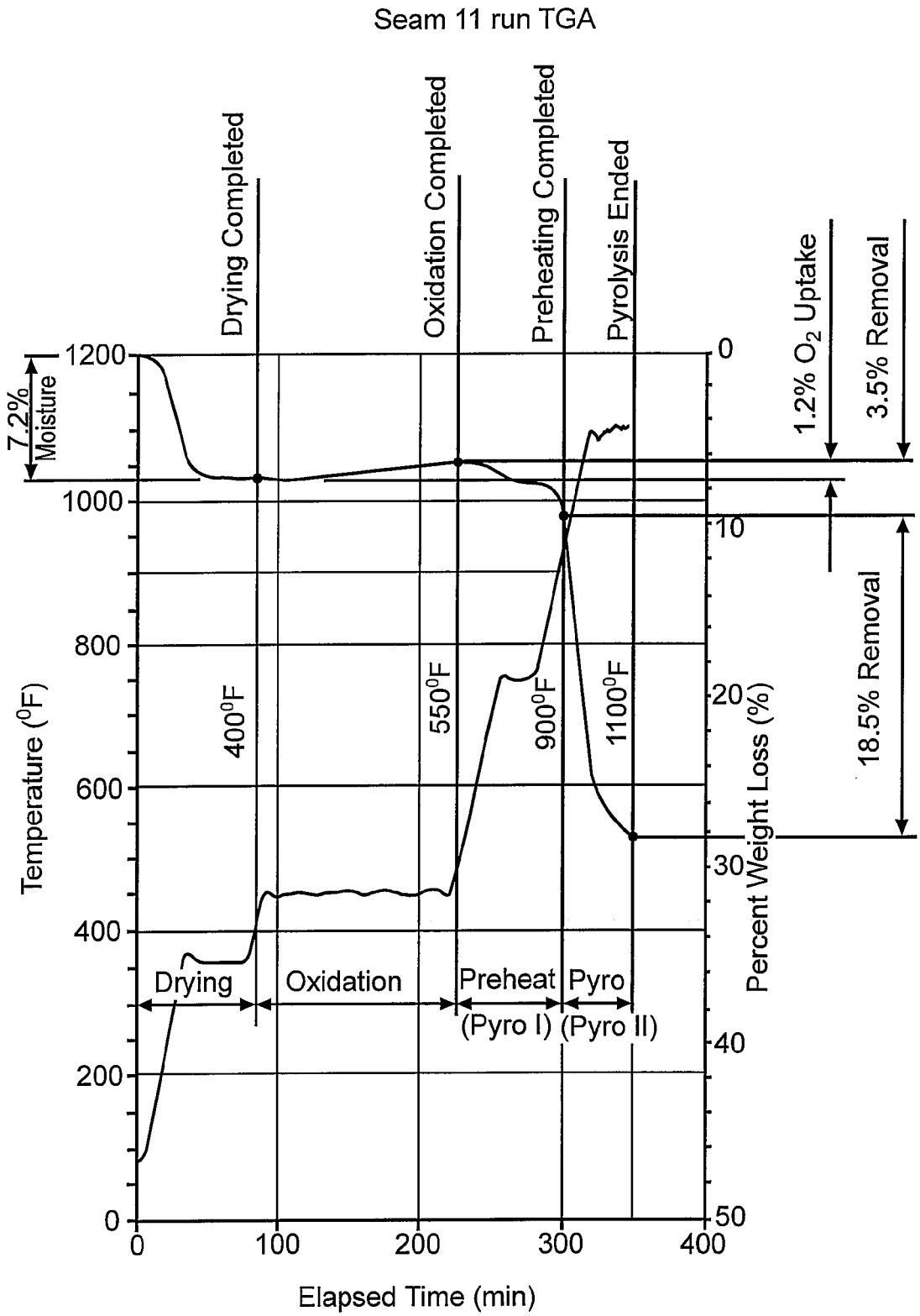
FIG. 6 is a schematic illustration of a graph showing the thermo-gravimetric analysis (TGA) of a seam of agglomerating coal having an initial free-swelling index (FSI) of 4 subsequently reduced to 1 according to the process of FIGS. 1 and 2.

FIG. 6 is a schematic graph illustrating the thermogravimetric analysis (TGA) of Western Kentucky, Ohio County, bituminous coal (Seam 11). Seam 11 coal had an initial free-swelling index (FSI) of 4, which was lowered to 1 according to the process described herein. It should be understood that the Elapsed Time is not representative of actual practice. During the pretreatment (oxidation) step, the oxygen uptake was 1.2%, with oxidation completed at 550° F. The coal was then pre-heated to 900° F. from 550° F., which pre-heating caused removal of about 3.5% of coal volatiles plus the carbon-oxygen compounds formed on the surface of the coal particles during the prior oxidation step. During the pyrolysis step, the pre-heated coal was heated to a temperature of 1100° F., with about 18.5% of the remaining coal volatile components being removed from the treated coal.

Example III

Figure 7:
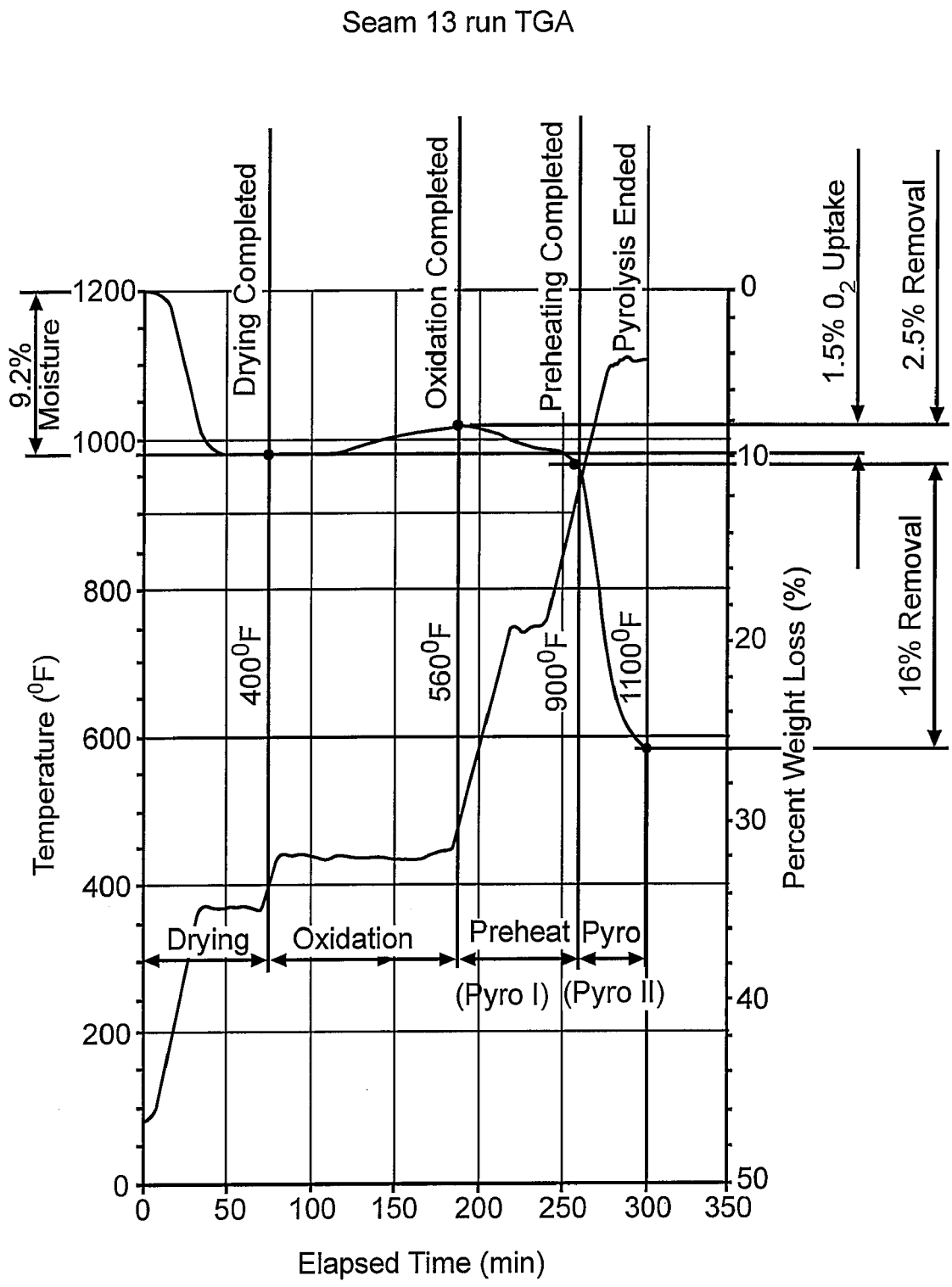
FIG. 7 is a schematic illustration of a graph showing the thermo-gravimetric analysis (TGA) of another seam of agglomerating coal having an initial free-swelling index (FSI) of 4 subsequently reduced to 1 according to the process of FIGS. 1 and 2.

FIG. 7 is a schematic graph illustrating the thermogravimetric analysis (TGA) of Western Kentucky, Ohio County, bituminous coal (Seam 13). Seam 13 coal had an initial free-swelling index (FSI) of 4, which was lowered to 1 according to the process described herein. It should be understood that the Elapsed Time is not representative of actual practice. During the pretreatment (oxidation) step, the oxygen uptake was 1.5%, with oxidation completed at 550° F. The coal was then pre-heated to 900° F. from 550° F., which pre-heating caused removal of about 2.5% of coal volatiles plus the carbon-oxygen compounds formed on the surface of the coal particles during the prior oxidation step. During the pyrolysis step, the pre-heated coal was heated to a temperature of 1100° F., with about 16% of the remaining coal volatile components being removed from the treated coal.

Gases from Seam 13 were analyzed using the Fourier Transform Infrared Spectrometer (FTIR). The objective was to determine if the condensable hydrocarbons (aromatic) would be released below an optimum upper pre-heating temperature. The FTIR data indicates that the desirable coal tar compounds (aromatic) were released at a temperature above 897° F. Therefore, the upper limit for pre-heating coal, Western Kentucky, Ohio County, Seam 13, is about 900° F.

Example IV

Figure 8:
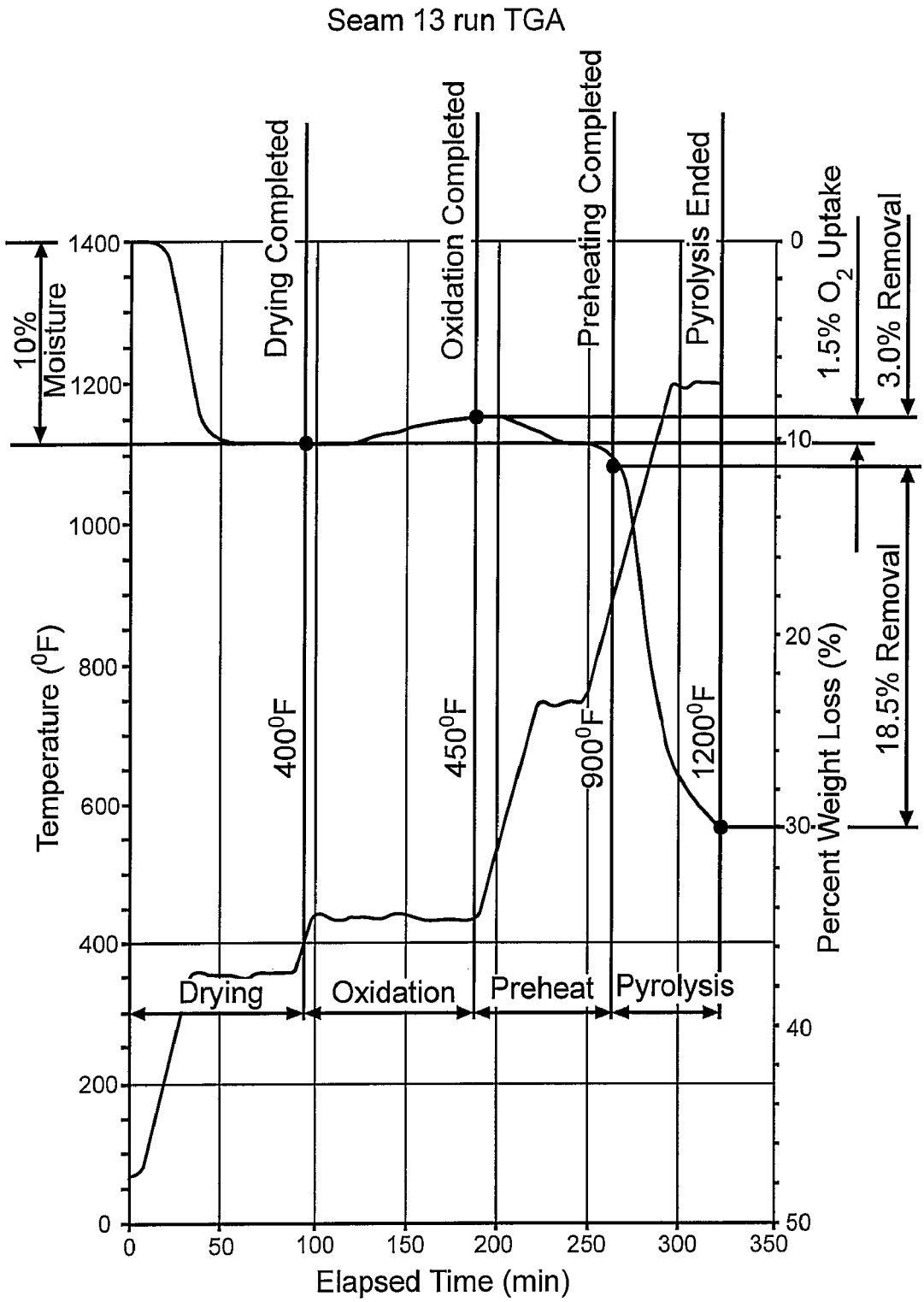
FIG. 8 is a schematic illustration of a graph showing the thermo-gravimetric analysis (TGA) of another seam of agglomerating coal having an initial free-swelling index (FSI) of 4 subsequently reduced to 1 according to the process of FIGS. 1 and 2.

FIG. 8 is a schematic graph illustrating the thermogravimetric analysis (TGA) of Western Kentucky, Ohio County, bituminous coal (Seam 13). Seam 13 coal had an initial free-swelling index (FSI) of 4, which was lowered to 1 according to the process described herein. It should be understood that the Elapsed Time is not representative of actual practice. During the pretreatment (oxidation) step, the oxygen uptake was 1.5%, with oxidation completed at 450° F. The coal was then pre-heated to 900° F. from 450° F., which pre-heating caused removal of non-condensable coal volatiles plus the carbon-oxygen compounds formed on the surface of the coal particles during the prior oxidation step. During the pyrolysis step, the pre-heated coal was heated to a temperature of 1200° F., with about 18.5% of the remaining coal volatile components being removed from the treated coal.

While the invention has been described with reference to various and preferred embodiments, it should be understood by those skilled in the art that various changes may be made and equivalents may be substituted for elements thereof without departing from the essential scope of the invention. In addition, many modifications may be made to adapt a particular situation or material to the teachings of the invention without departing from the essential scope thereof.

Therefore, it is intended that the invention not be limited to the particular embodiment disclosed herein contemplated for carrying out this invention, but that the invention will include all embodiments falling within the scope of the claims.

What is claimed is:

1. A process for treating agglomerating coal, the process comprising:

providing dried, pulverized, agglomerating coal;

treating the coal in a vessel with a gas stream having an oxygen content sufficient to form at least some oxides on a surface of the coal particles, wherein the oxides are sufficient to convert the coal into substantially non-agglomerating coal;

transferring the treated coal into a pyrolyzing chamber and passing an oxygen deficient sweep gas into contact with the coal, the sweep gas being at a higher temperature than the temperature of the coal so that heat is supplied to the coal;

providing additional heat to the coal indirectly by heating the chamber, wherein the heating of the coal by the sweep gas and by the indirect heating from the chamber causes condensable volatile components to be released into the sweep gas;

removing the sweep gas from the chamber; and treating the sweep gas to remove condensable components of the coal.

2. The process of claim 1, wherein the coal is pulverized to a size within a range of from about minus 40 mesh to about minus 200 mesh.

3. The process of claim 1, wherein the oxygen content of the gas stream is sufficient to cause the coal to gain weight in an amount within a range of from about 0.5% to about 2.0% of the weight of the coal when the coal is treated for a time of about 30 minutes at a temperature within a range of from about 400° F. to about 600° F.

4. The process of claim 1, wherein the treating of the coal with the gas stream includes heating the coal to a temperature within a range of from about 400° F. to about 650° F. in an oxidizing rotary retort or an oxidizing fluidized bed vessel.

5. The process of claim 1 further including pre-heating the treated coal by heating the coal to a temperature within a range of from about 550° F. to about 900° F. in a pre-heat rotary retort or a pre-heat fluidized bed vessel.

6. The process of claim 5, wherein the temperature of the pre-heat rotary retort or pre-heat fluidized bed vessel is controlled to about 550-900° F. so as to remove about 2% to about 10% by weight of coal volatile components from the treated coal while allowing desirable volatiles to remain with the coal particles.

7. The process of claim 1, wherein the pyrolyzing chamber is a rotary retort, and the treated coal is heated in the retort to a temperature within a range of from about 900° F. to about 1200° F. so as to produce pulverized coal char, with the sweep gas removed from the chamber having a condensable hydrocarbon content of at least 25%.

8. The process of claim 1, wherein coal is continuously supplied into one end of the chamber and removed from another end of the chamber, the sweep gas is continuously supplied into one end of the chamber and removed from another end of the chamber, and the sweep gas exiting the chamber has a condensable hydrocarbon content of at least 25% by weight.

9. The process of claim 1, wherein the sweep gas removed from the chamber includes at least one of $C_3H_8$, $CH_4$, and CO, and further includes at least one of $H_2S$, $CS_2$, and COS.

10. The process of claim 1, wherein the agglomerating coal has a free-swelling index (FSI) of about 4 or more, which is reduced to an FSI of about 1 or less following treatment of the agglomerating coal.

11. A process for treating agglomerating coal, the process comprising:

providing dried, pulverized, agglomerating coal;

pre-heating the coal by heating the coal to a temperature within a range of from about 550° F. to about 900° F. in a pre-heat rotary retort or a pre-heat fluidized bed vessel;

transferring the coal into a pyrolyzing chamber and passing an oxygen deficient sweep gas into contact with the coal, the sweep gas being at a higher temperature than the temperature of the coal so that heat is supplied to the coal;

providing additional heat to the coal indirectly by heating the chamber, wherein the heating of the coal by the sweep gas and by the indirect heating from the chamber causes condensable volatile components to be released into the sweep gas;

removing the sweep gas from the chamber; and treating the sweep gas to remove condensable components of the coal.

12. The process of claim 11, wherein the temperature of the pre-heat rotary retort or pre-heat fluidized bed vessel is controlled to about 600-900° F. so as to remove about 2% to about 10% by weight of coal volatile components from the treated coal while allowing desirable volatiles to remain with the coal particles.

13. The process of claim 11, wherein the pyrolyzing chamber is a rotary retort, and the pre-heated coal is heated in the retort to a temperature within a range of from about 850° F. to about 1200° F. so as to produce pulverized coal char, with the sweep gas removed from the chamber having a condensable hydrocarbon content of at least 25%.

14. A process for converting agglomerating coal into non-agglomerating coal, the process comprising:

heating a pulverized agglomerating coal to a temperature from about 400 F to about 600 F in a gas stream having an oxygen content sufficient to form at least some oxides on a surface of the coal particles, wherein the oxides are sufficient to convert the coal into substantially non-agglomerating, treated coal.

15. The process of claim 14, wherein the oxygen content of the gas stream and the heating conditions are sufficient to cause an oxide weight gain in the treated coal from about 0.5% to about 2.0% of the weight of the coal.

16. The process of claim 14, further comprising a step of preheating the treated coal to about 550-900° F. so as to remove about 2% to about 10% by weight of coal volatile components from the treated coal while allowing desirable volatiles to remain with the coal particles.

17. The process of claim 14, further comprising pyrolyzing the treated coal in a chamber with an oxygen-deficient sweep gas, the sweep gas removed from the chamber having a condensable hydrocarbon content of at least 25%.

18. The process of claim 14, wherein the coal is pulverized to a size within a range of from about minus 40 mesh to about minus 200 mesh.

19. A process for reducing the free-swelling index of an agglomerating coal, the process comprising:

heating a pulverized agglomerating coal to a temperature from about 400 F to about 600 F in a gas stream having an oxygen content sufficient to form at least some oxides on a surface of the coal particles, wherein the oxides are sufficient to convert the coal into substantially non-agglomerating, treated coal.

20. The process of claim 19, wherein the free-swelling index is reduced to about 1.0 or less in the treated coal.

21. The process of claim 20, wherein the agglomerating coal initially has a free-swelling index (FSI) of about 4 or more.

22. The process of claim 19, wherein the oxygen content of the gas stream and the heating conditions are sufficient to cause an oxide weight gain in the treated coal from about 0.5% to about 2.0% of the weight of the coal.

23. The process of claim 19, further comprising a step of preheating the treated coal to about 550-900° F. so as to remove about 2% to about 10% by weight of coal volatile components from the treated coal while allowing desirable volatiles to remain with the coal particles.

24. The process of claim 19, further comprising pyrolyzing the treated coal in a chamber with an oxygen-deficient sweep gas, the sweep gas removed from the chamber having a condensable hydrocarbon content of at least 25%.

25. The process of claim 19, wherein the coal is pulverized to a size within a range of from about minus 40 mesh to about minus 200 mesh.

* * * * *